United States Patent [19]

Harrison

[11] Patent Number: 4,909,652

[45] Date of Patent: Mar. 20, 1990

[54] STORAGE DEVICE

[76] Inventor: Michael A. Harrison, 16148 Healdsburg Ave., Healdsburg, Calif. 95448

[21] Appl. No.: 208,778

[22] Filed: Jun. 17, 1988

[51] Int. Cl.[4] ..... B42D 13/00

[52] U.S. Cl. ..... 402/80 R; 402/4; 281/30

[58] Field of Search ..... 402/4, 80 R; 281/30

[56] References Cited

U.S. PATENT DOCUMENTS 457,947 8/1891 Worley ..... 281/30 X
2,647,517 4/1953 Bilbrey ..... 281/30 X

FOREIGN PATENT DOCUMENTS 1396190 8/1965 France ..... 402/4
357775 3/1938 Italy ..... 281/30
1564220 4/1980 United Kingdom ..... 281/30

*Primary Examiner*—Paul A. Bell
*Attorney, Agent, or Firm*—Larry D. Johnson

[57] ABSTRACT

The storage device of this invention provides an improved accessory holder for standard ring binders having a plurality of ring guides attached to a binder spine-mounted back plate. The device comprises a generally hollow housing member conditioned for placement against and attachment to the binder back plate, and within the rings themselves, so as not to interfere with the sheets or other contents of the binder. The housing member has a central cavity for holding accessory items such as pencils, rulers, and the like, and includes a cap or door for access to the central cavity.

5 Claims, 3 Drawing Sheets

STORAGE DEVICE

BACKGROUND OF THE INVENTION

1. Field of the Invention

This invention relates generally to storage containers, and more specifically to an improved accessory storage device for ring binders.

2. Description of the Prior Art

Ring binders and other document carriers are widely used for holding, organizing, and protecting sheets of paper and other contents. It is of course often desirable to have access to pencils, pens, rulers and other accessories to work on these papers. While such accessories can sometimes be carried on the person, it is often awkward and inefficient to do so.

Numerous accessory holders have been developed to store such accessories on or near the ring binder. For example, some accessory holders consist of a pocket or sleeve on the inside cover of the binder itself. Unfortunately, such storage space is necessarily narrow in dimension, and the accessories stored there frequently fall out or are misplaced. Other accessory holders provide a sealable envelope fitting among the sheets on the rings themselves. However, such pockets are relatively bulky, and frequently interfere with the sheets or other contents of the binder.

SUMMARY OF THE INVENTION

The storage device of this invention provides an improved accessory holder for standard ring binders having a plurality of ring guides attached to a binder spine-mounted back plate. The device comprises a generally hollow housing member conditioned for placement against and attachment to the binder back plate, and within the rings themselves, so as not to interfere with the sheets or other contents of the binder. The housing member has a central cavity for holding accessory items such as pencils, rulers, and the like, and includes a cap or door for access to the central cavity.

In a basic embodiment, the housing member is a generally hollow cylinder with one or both ends bearing a removable cap enabling access to the cavity. The housing is attached to the binder back plate by fastening bands, adhesive strips, or similar fastening means. The housing member may be of different shape (e.g., square) to more efficiently fit within similarly shaped rings.

In an alternate embodiment, the housing member is sealed at both ends, but includes a sliding door along at least part of its circumferential surface to enable access to the central cavity. Such an arrangement is desirable, for example, with ring binders bearing ring opening levers at one or both ends of the binder back plate, which levers would interfere with removal of a standard housing member end cap.

In a further alternate embodiment, the housing member comprises an inner and outer tube in telescoping engagement, so that the inner tube is slidable into and out of the outer tube. In this embodiment, the inner tube includes a large cut-out portion defining the access to its internal cavity when the tubes are telescoped apart, and the outer tube acts as a cover to retain the accessory contents when the tubes are telescoped together.

BRIEF DESCRIPTION OF THE DRAWINGS

FIG. 1 is a perspective view of a basic embodiment of the storage device as fastened in place in a typical ring binder;

FIG. 2 is a side elevational view of a basic embodiment of the storage device as fastened in place; and FIG. 3 is an elevated cross sectional view of a basic embodiment of the storage device, this view taken along line 3—3 of FIG. 2;

FIG. 4 is a side elevational view of a sliding door embodiment of the storage device as fastened in place; and FIG. 5 is an elevated cross sectional view of a sliding door embodiment of the storage device, this view taken along line 5—5 of FIG. 4;

FIG. 7 is a perspective view of a telescoping tube embodiment of the storage device as fastened in place;

FIG. 8 is a perspective view of the inner and outer tubes of a telescoping tube embodiment of the storage device;

FIG. 9 is a side elevational view of the outer tube of a telescoping tube embodiment of the storage device; and FIG. 10 is a side elevational view of the inner tube of a telescoping tube embodiment of the storage device.

DETAILED DESCRIPTION OF A PREFERRED EMBODIMENT

Figure 1:
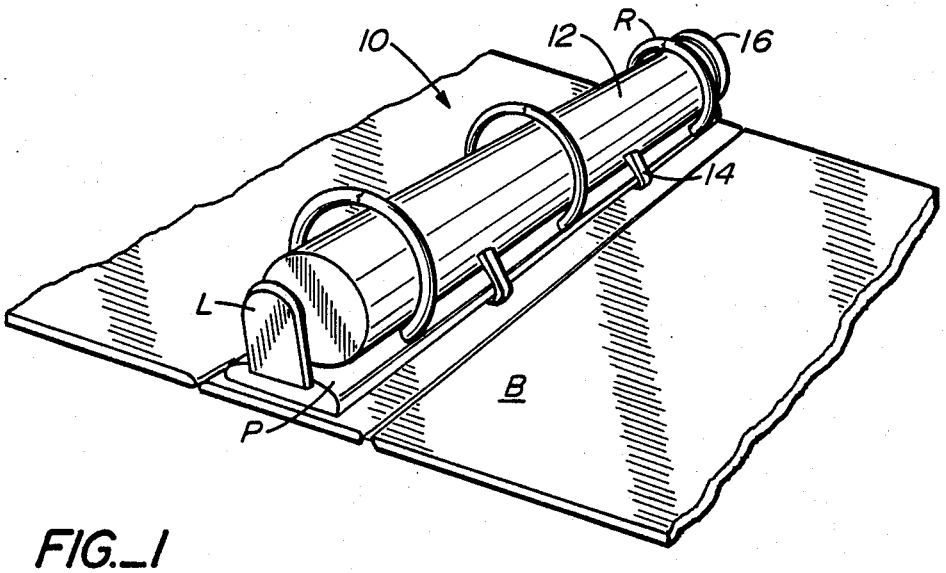
FIGS. 1–3 are views of a basic embodiment of the storage device of this invention.

FIG. 1 is a perspective view of a basic embodiment of the storage device as fastened in place in a typical ring binder B. Storage device 10 comprises a generally hollow cylindrical housing member 12 that attaches to the back plate P and within the rings R of binder B. Housing 12 attaches to the back plate P by means of a fastening band 14, which can be a rubber band or similar device. Housing 12 includes a cap 16 for access to the interior of the housing for storage of accessory items. Such a cap should preferably be positioned opposite any ring opening lever L that may be on the back plate.

Figure 2:
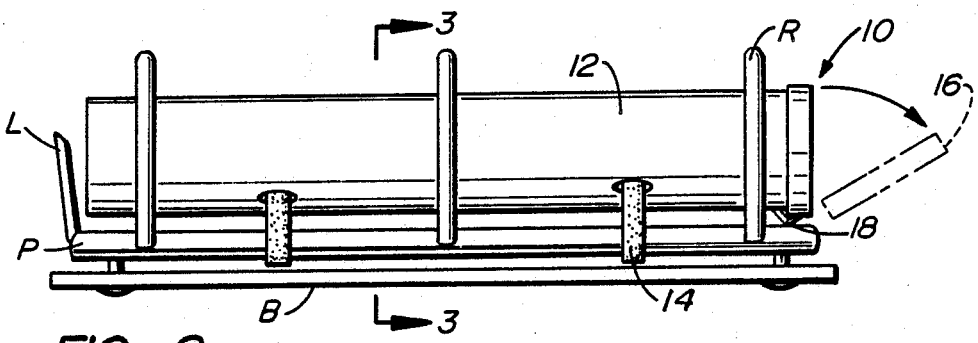

FIG. 2 is a side elevational view of a basic embodiment of the storage device 10 as fastened in place in a binder. This view illustrates cap 16 being removable from housing 12, and tethered by cap retainer 18. Thus, the storage device is readily accessed for insertion or removal of accessories.

Figure 3:
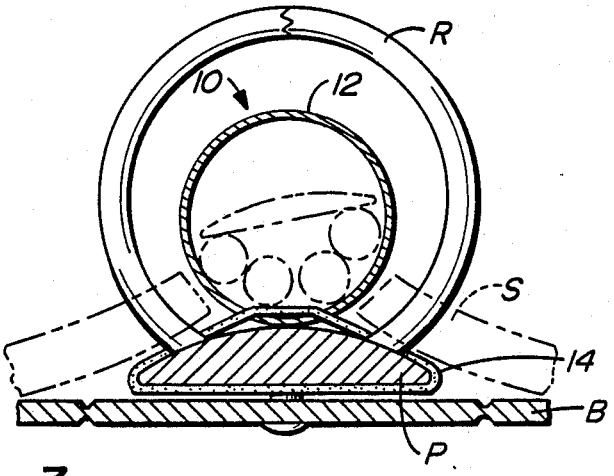

FIG. 3 is an elevated cross-sectional view of a basic embodiment of the storage device 10, this view taken along line 3—3 of FIG. 2. This view illustrates that the housing member 12 easily holds accessories such as rulers and pencils (shown in phantom), while not interfering with sheets S or other materials held by the rings of the binder.

Figure 4:
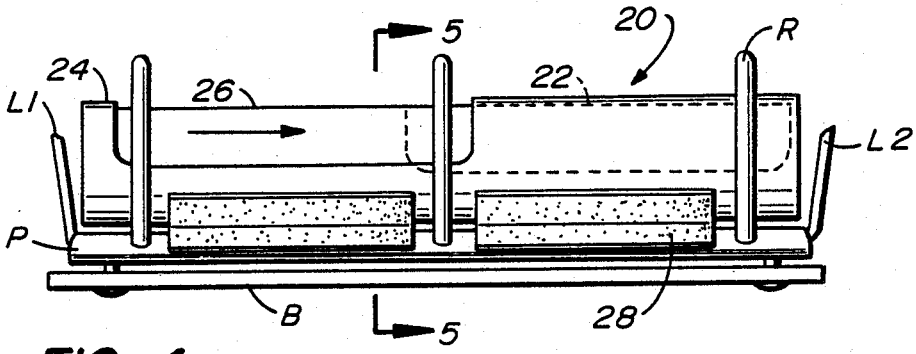
FIGS. 4–5 are views of a sliding door embodiment of the storage device of this invention.

FIG. 4 is a side elevational view of a sliding door embodiment 20 of the storage device as fastened in place. In this embodiment, housing 22 is closed off and sealed at both ends, but includes a cut-out portion of 24 along at least part of its circumferential surface, into which a sliding door 26 can be moved back and forth to expose the central cavity. This embodiment is appropriate when the ring binder includes a pair of opening levers L1, L2, which would interfere with removal of a standard housing end cap. This view also illustrates an alternate fastening method for the storage device, that of fastening strip 28, which can be a piece of two-sided adhesive, peel-and-stick fastening material, or the like.

Figure 5:
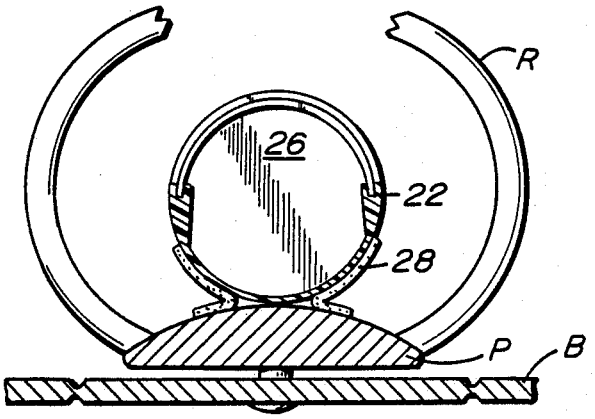

FIG. 5 is an elevated cross-sectional view of a sliding door embodiment of the storage device, this view taken along line 5—5 of FIG. 4. This view illustrates ring R of the binder in its open configuration, which may or may not be necessary to enable unobstructed access to sliding door 26.

Figure 6:
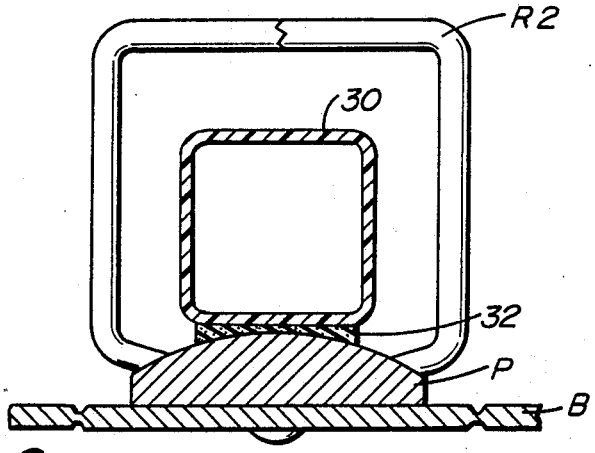
FIG. 6 is an elevated cross sectional view of a square housing embodiment of the storage device of this invention.

FIG. 6 is an elevated cross-sectional view of a square housing embodiment 30 of the storage device of this invention. This embodiment is appropriate when the binder includes "square" rings R2. This view also illustrates yet another alternate fastening method for the storage device, that of a strip of foam adhesive tape 32.

Figure 7:
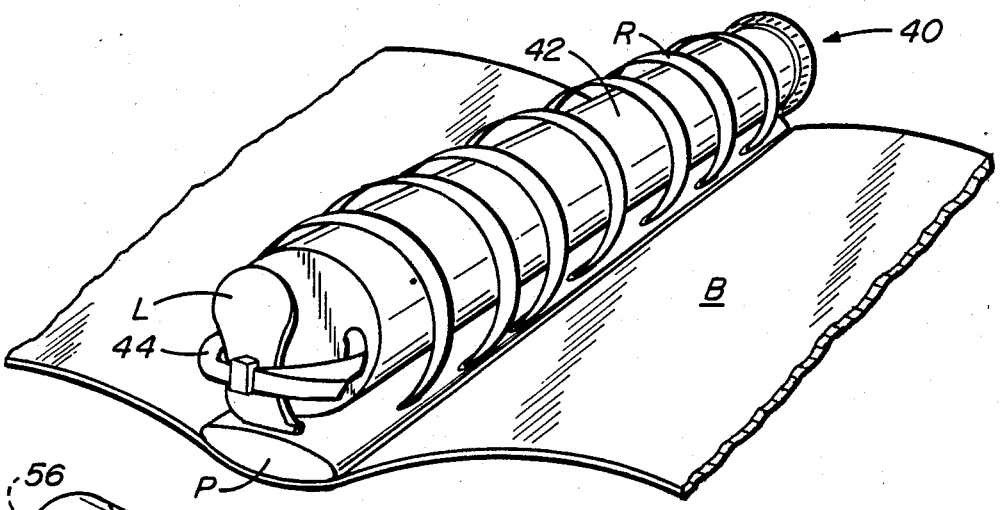
FIGS. 7–10 are views of a telescoping tube embodiment of the storage device of this invention.

FIG. 7 is a perspective view of a telescoping tube embodiment 40 of the storage device as fastened in place. In outward appearance, this embodiment is similar to the basic embodiment (FIGS. 1–3), showing a housing 42 wholly contained within rings R of the binder. Here, though, the housing includes a pair of telescoping tube members (described infra). This view does illustrate yet a further alternate fastening method for the storage device, that of a fastening strap 44 used to secure the housing 42 to ring opening lever L.

Figure 8:
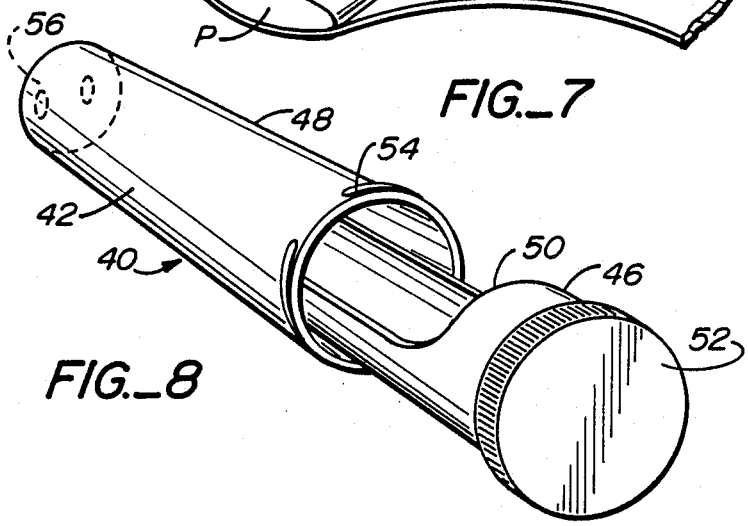

FIG. 8 is a perspective view of the inner tube 46 and outer tube 48 of a telescoping tube embodiment 40 of the storage device. These tubes define concentric cylinders, enabling their telescoping engagement. Inner tube 46 includes a relatively large cut-out portion 50 to hold and carry the desired accessories, and a fixed cap 52 that engages threads 54 on the outer tube to enable a quick (e.g., half turn) release of the inner tube from the outer tube. Outer tube 48 can be seen to include fastening strap holes 56 for engagement with the fastening strap.

Figure 9:
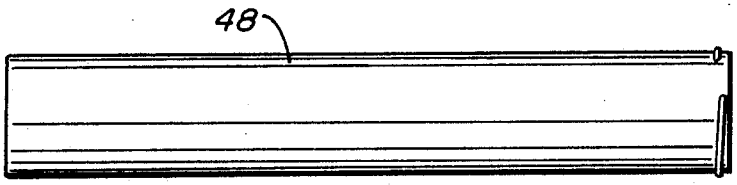

FIG. 9 is a side elevational view of the outer tube 48 of a telescoping tube embodiment of the storage device. Outer tube 48 may be of any appropriate dimensions to fit within the rings of a standard binder. For example, outer tube 48 may be a cylinder of approximately eight and one-eighths inches in length and one and one-half inches in diameter.

Figure 10:
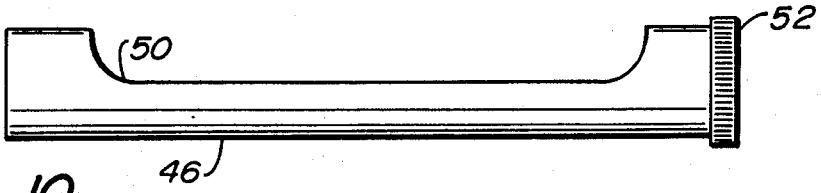

FIG. 10 is a side elevational view of the inner tube 46 of a telescoping tube embodiment of the storage device. Inner tube 46 should of course be of a dimension to slidably engage within outer tube 48. For example, inner tube 46 may be approximately eight inches in length and one and one-quarter inches in diameter, and have a seven inch cut-out portion along its circumferential surface.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. An accessory holder for ring binders having a plurality of ring guides attached to a binder spine-mounted back plate, said accessory holder comprising:

a housing member having a circumferential surface defining a central cavity for holding accessory items, said housing member conditioned to fit within the circumference of said ring guides;

door means on said housing member circumferential surface enabling access to and sealing of said central cavity, said door means comprising a sliding door movable back and forth to expose said central cavity; and fastening means for securing said housing member to said binder back plate.

2. The accessory holder of claim 1 wherein said ring guides are circular in shape, and said housing member comprises a hollow cylinder.

3. The accessory holder of claim 1 wherein said fastening means comprises a band of elastic material attachable to said binder spine.

4. The accessory holder of claim 1 wherein said fastening means comprises an adhesive strip.

5. An accessory holder for ring binders having a plurality of ring guides attached to a binder spine-mounted back plate, said accessory holder comprising:

a housing member having a circumferential surface defining a central cavity for holding accessory items, said housing member conditioned to fit within the circumference of said ring guides, said housing member comprising an inner tube member and an outer tube member slidable together in telescoping engagement, said inner tube member including a cutout portion enabling access to said central cavity; and fastening means for securing said housing member to said binder back plate.

* * * * *